United States Patent [19]

Reijnders et al.

[11] 4,067,160

[45] Jan. 10, 1978

[54] CONCRETE RESERVOIR COMPOSED OF PREFABRICATED SECTIONS

[75] Inventors: Arnoldus J. Reijnders, Voerendaal; Jacobus J. Hage, Sittard; Peter J. Segers, Heerlen, all of Netherlands

[73] Assignee: Stamicarbon, B.V., Geleen, Netherlands

[21] Appl. No.: 679,494

[22] Filed: Apr. 22, 1976

[30] Foreign Application Priority Data

Apr. 29, 1975 Netherlands ..... 7505062

[51] Int. Cl.[2] ..... E04C 2/04; E04G 11/06; E04H 7/26

[52] U.S. Cl. ..... 52/245; 52/396; 52/469; 52/573

[58] Field of Search ..... 52/245, 247, 248, 395, 52/396, 469, 468, 573

[56] References Cited

U.S. PATENT DOCUMENTS

| | | | |
|---|---|---|---|
| 640,840 | 1/1900 | Wadsworth | 52/469 X |
| 1,162,085 | 11/1915 | Layton | 52/248 |
| 1,862,292 | 6/1932 | Bennett | 52/465 X |
| 3,763,608 | 10/1973 | Chamlee | 52/469 |

FOREIGN PATENT DOCUMENTS

| | | | |
|---|---|---|---|
| 1,201,990 | 7/1959 | France | 52/469 |
| 2,041,142 | 2/1972 | Germany | 52/245 |
| 2,248,196 | 4/1974 | Germany | 52/396 |
| 1,285,156 | 12/1968 | Germany | 52/573 |
| 103,672 | 2/1942 | Sweden | 52/573 |

*Primary Examiner*—Alfred C. Perham
*Attorney, Agent, or Firm*—Cushman, Darby & Cushman

[57] ABSTRACT

A reservoir consisting of a system of contiguous, prefabricated, plate-shaped concrete sections that are connected in a water-tight way, comprising that (1) the plate-shape concrete sections are flat or slightly bent and include a large angle when assembled, (2) the concrete sections are clamped in on side in a foundation running the full length of the reservoir circumference, (3) the sides of the concrete sections are connected exclusively by a pliable seal.

7 Claims, 5 Drawing Figures

CONCRETE RESERVOIR COMPOSED OF PREFABRICATED SECTIONS

Figure 1:
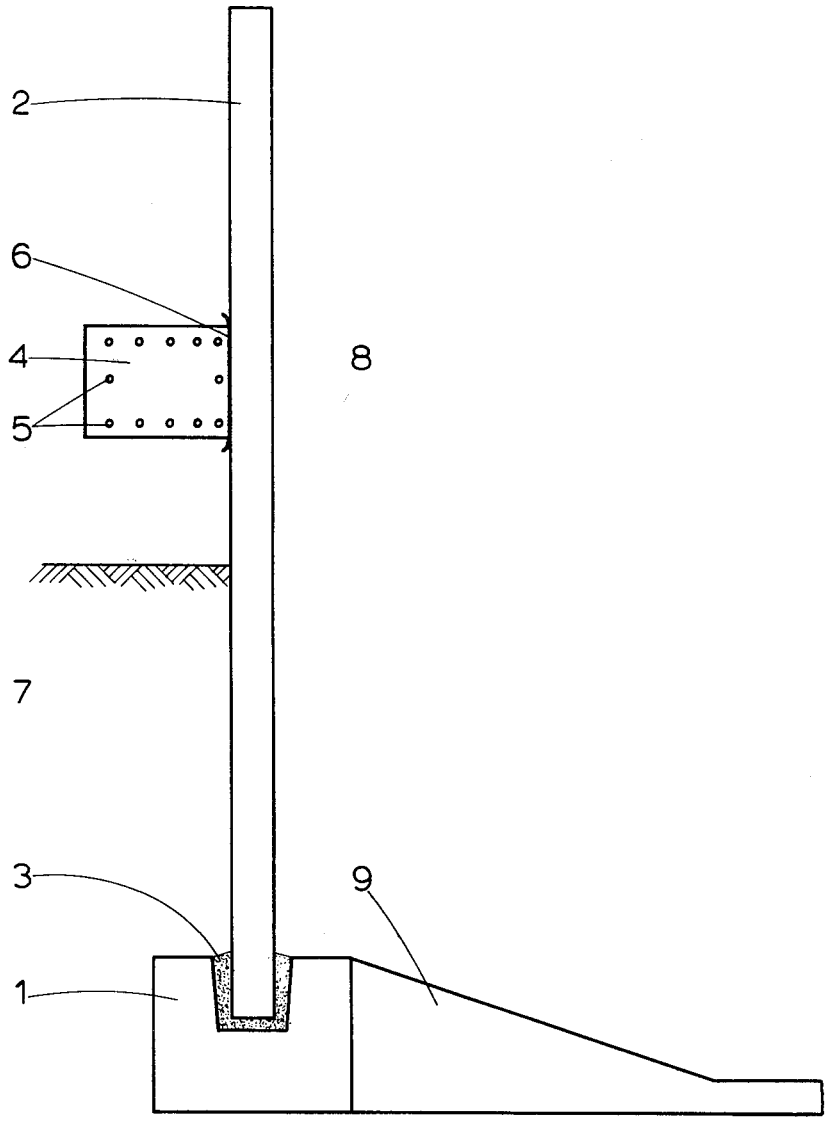

The invention relates to a reservoir consisting of a system of contiguous, prefabricated, plate-shaped concrete sections that are connected in water-tight way.

Reservoirs, particularly sewer gullies, of the type meant above are well known. The prefabricated plate-shaped sections are so arranged with respect to each other that a rectangular of virtually rectangular shape is obtained. The sections are rigidly connected and support each other, partly because they include an angle of about 90° C. The joints are filled up with putty or cement mortar.

Attemps are made at building also big, polygonal, approximately round reservoirs out of prefabricated, plate-shaped concrete sections. The concrete sections then include an angle that is greater than 90°, e.g. over 120° C, such as of the order of 150° up to even 180° if the sections are slightly bent. Especially when big reservoirs are concerned, where the soil pressure is considerable on the one side, and the water pressure on the other, the rigid interconnection of the sections presents problems. Hence, big reservoirs composed of prefabricated sections (e.g. with a diameter of the order of 10 meters and more) are not built. Reservoirs of this size are used, i.a., in installations for the purification of waste water.

The object of the invention is to find a simple solution for the efficient assembly of polygonal, approximately round reservoirs out of a system of contiguous, prefabricated, plate-shaped sections that are connected in a water-tight way.

According to the invention, this is achieved, if:

1. the plate-shaped concrete sections are flat or slightly bent and include a large angle when assembled;
2. the lower sides of the concrete sections are clamped in a foundation running the full length of the reservoir circumference;
3. the sides of the concrete sections are connected exclusively by a pliable seal.

When the height of the assembled concrete sections is at least 2 meters, a reinforced-concrete ring that is not rigidly connected to the concrete sections is preferably mounted around the reservoir.

The method of clamping the concrete sections in the foundation running the full length of the reservoir circumference is essential to the invention. In this way the sections are kept in the right position individually and with respect to each other. The continuous foundation then ensures sufficiently great stability. In reservoirs of smaller dimensions, deformation caused by water pressure play a minor part and the elements may be rigidly connected in a simple way. In reservoirs of greater dimensions, e.g. with a height of 2 meters or more and a dimater of 10 m, condisderable forces and deformations of the sections occur. Here, rigid connection of the sections cannot be effected in a simple way. According to the embodiment of the invention, such a rigid connection is not necessary at all. This makes it quite well possible to use prefabricated concrete sections. It goes without saying that there is no objection to assembling small reservoirs in the same way.

The presence or absence of the concrete ring at a height of at least 2 meters depends on local conditions, e.g. whether the reservoir rises high over the earth's surface, or on the soil conditions. The ring is not rigidly connected to the sections; e.g. plastics film may be present between the ring and the sections. Naturally, the ring must be kept in place by conventional means. The reason why the ring is not rigidly connected to the sections is to prevent deformations, e.g. elongation caused by the water pressure, from being transmitted to the separate sections. If the ring can be omitted, for whatever reason, the essence of the invention is not affected.

In a preferable embodiment, the pliable seals are so fitted to the vertical edges of the sections that they are received in a rabbet receding from the produced front plane of the sections and, hence, do not project from the inner wall of the reservoir.

A further object of the inventon is to provide a simple pliable seal between the concrete sections of a reservoir of the type described. The seal must be able to withstand the water pressure from the inside of the reservoir and must preferably be separable.

A simple embodiment consists in that the concrete sections are provided with anchoring means in a rabbet near the vertical edges of the sections, the sections are connected by a rubber plate through which the anchoring means pass and the sides of the rubber plate are pressed against the concrete of the sections by means of continuous strips that are secured by the anchoring means. The anchoring means may be conventional means consisting of a threaded socket cast in the concrete and a matching bolt or a cast-in bolt with a matching nut.

Separable rubber seals that can be cast in during the manufacture of the concrete sections are well known, e.g. from German patent application 1808092.

Seals of this type are complicated, making the cost of the mould high. Moreover, the connection is not easy to make in the case of long joints and it is less resistant to water pressure. The invention provides a more suitable embodiment.

The invention also relates to a separable rubber seal for sealing the joint between two adjacent concrete sections of a reservoir according to the invention, each half of this seal consisting of a securing end that can be incorporated in a concrete section and a sealing end that, at least in the assembled position, is bent at reight angles and can be provided with means for fastening the sealing end of this half to the corresponding end of the other half.

According to the invention, the sealing ends of the rubber seal abut against each other over some length and the fastening means press the abutting parts together with some force. According to one embodiment, the sealing end of each half, at the side away from the other half, changes into a thickened part, a rigid bar being placed near the transition in the assembled condition, while a number of approximately U-shaped clasps press the bars of corresponding sealing ends towards each other and keep them in place at the transitions towards the thickened ends, the legs of the U-shaped clasps being provided for this purpose with local bent-out parts. It will be clear that the bar is placed at the transition towards the thickened part to be able to secure it into place. The bars are usually made of metal and may be solid or hollow. The number of clasps depends on the dimensions and on the liquid pressure acting on the seal. By preference, the clasps are also made of steel. The clasps are fitted one by one, when the bars are strongly pressed together with tools so that the ends of the clasp that grip round the bars can be pushed home. Naturally, the clasps are so dimensioned that compressive force continues to be exterted after removal of the auxiliary tools, so that the bars are pressed against the halves of the rubber seals.

According to another embodiment, the sealing ends of each half of the rubber seal, at the side away from the other half, are pressed together, in the assembled condition, springy continuous or interrupted, approximately U-shaped clamping strip mounted over the extremities of the sealing ends, the legs of the strip being provided with a local bent-in part that presses into the rubber.

According to a further embodiment, the sealings ends of each half of the rubber seal, at side away from the other half, are pressed together, in the assembled condition, by the edges of a continuous or interrupted, springy, tubular clamping strip that has been cut lengthwise and has been placed over the extremities of the sealing ends, the edges of the cut part pressing into the rubber behind the thickened ends of the rubber seal.

The ends of the rubber sealing halves that are incorporated in the concrete of the sections are preferably provided, in a known way, with means for effecting proper anchorage. A well-known example is the presence of a perforation or a thickening. In the non-assembled condition, the rubber halves need not necessarily be bent at right angles: their elasticity permits of bending them at right angles during assembly. In this case, the distance between the concrete sections is also less critical: the sealing ends adapt themselves to this distance. This is also important to permit of some movement at fluctuating water pressure. To prevent the assembled seal from bulging out owing to water pressure, it is desirable that parts belonging to the concrete sections extend behind the sealing end or that stay plates are incorporated in the concrete. Furthermore, it will be clear that, in addition to rubber, any other resistant elastic material may be used for the seal.

The invention will be explained with reference to drawings, where

Figure 2:
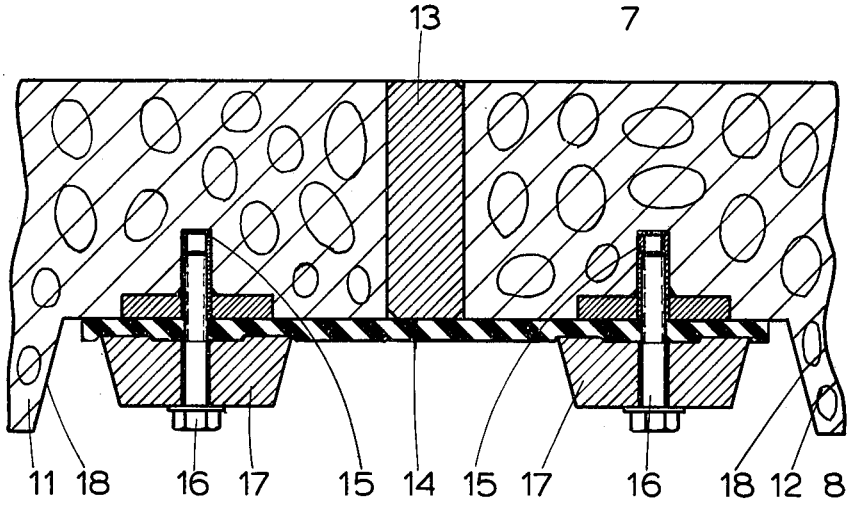

FIG. 1 shows a vertical section through a concrete section of a reservoir;

FIGS. 2 up to and including 5 show horizontal sections through embodiments of the joint seal according to the invention in the assembled condition.

The reference figures denote the following:

1. the roundabout foundation of a reservoir;
2. prefabricated concrete section forming part of a reservoir wall;
3. groove in the foundation 1, in which the section 2 is secured with cement mortar;
4. cross-section through the concrete ring mounted around the reservoir;
5. reinforcement rods in ring 4;
6. plastics film between ring 4 and section 2;
7. soil outside reservoir;
8. water in the reservoir;
9. bottom finish of the reservoir;
11,12. two adjacent concrete sections;
13. wooden or plastics spacer;
14. rubber plate
15. anchoring sockets
16. bolts fitting in sockets 15;
17. continuous strips;
18. rabbet at the edge of sections 11 and 12;
24,25. cast-in securing ends of two abutting halves of a rubber seal;
26,27. sealing ends of rubber seal;
28,29. thickened ends of sealing halves 26,27;
30,31. (hollow) steel bars mounted at the transition towards the extremities of the sealing ends;
32. steel clasp;
33,34. bent-out parts of clasp 32 that grip round bars 30,31;
37. other type of clasp having the shape of a clamping strip;
38,39. bent-in parts of the clamping strip 37;
40. springy tubular clamping strip cut lenthwise;
41,42. thickend ends of sealing halves 26,27;
43. holes in tubular clamping strip 40.

FIG. 1 shows a vertical section through a concrete section of a reservoir wall. The reservoir must be composed of a number of similar, fitting, prefabricated sections that include a large angle, e.g. of the order of 150° or more. The reservoir thus assembled approaches the round shape. If the sections are bent, the shape can be round and the included angle 180°. The height of section 2 may be, e.g. 6 m; in this case the reinforced-concrete ring is placed about 2 m below the upper edge. Plastics film 6 is fitted between section 2 and ring 4, so that there is no rigid connection between ring 4 and section 2.

Figure 3:
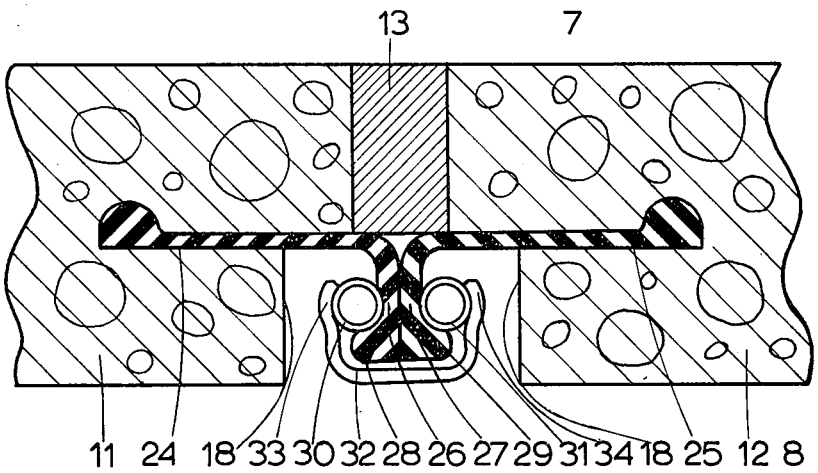
Figure 4:
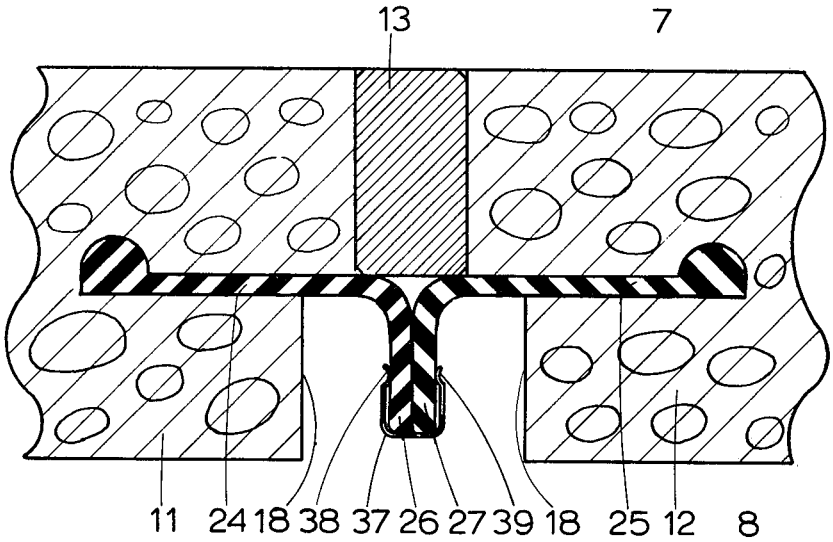
Figure 5:
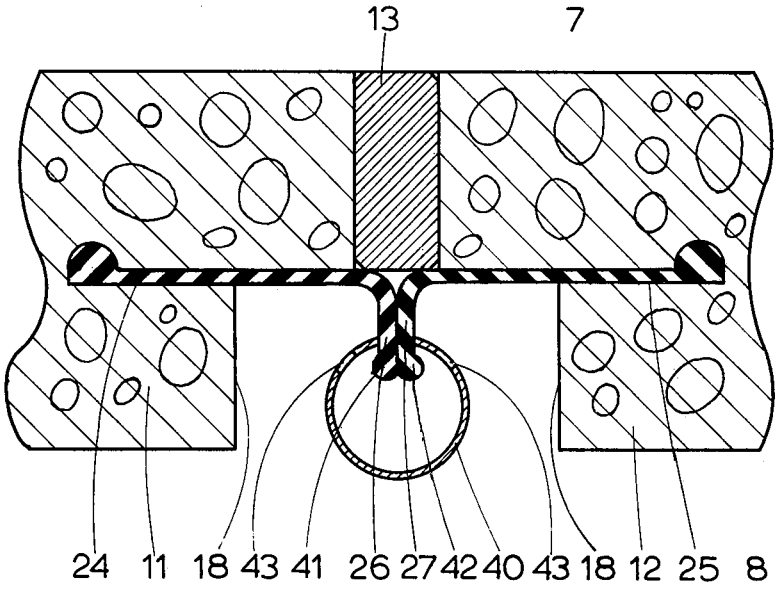

FIG. 2 shows a simple pliable rubber seal 14, which is fastened to the adjacent concrete sections in a watertight way by means of anchoring and clamping means 15, 16, 17 and which, just like those according to FIGS. 3 to 5, is received in a rabbet 18 along the edges of the concrete sections 11 and 12, so that it does not project from the wall of the reservoir. Spacer 13 neutralizes irregularities in the edge.

FIGS. 3–5 show other embodiments of the rubber seal. FIG. 3 shows the seal whose halves are held together by the bars 30 and 31, which are pressed towards each other by means of the steel clasps 32. To fit the clasps 32, the bars 30 and 31 are first pressed towards each other by means of tools, after which the clasp can easily be pressed home.

When the U-shaped clamping strip according to FIG. 4 is mounted, use is made of a continuous or interrupted strip 37 whose legs are provided with local bent-in parts 38, 39 and are at an angle of over 90° to the body, the clamping strip being placed over the ends of the abutting sealing halves, and the legs being pressed together with tools until the yield point is exceeded so that said angle becomes smaller than 90°. After the tools have been removed, said angle is about 90° and the bent-in parts 38 and 39 of the clamping strip 37 press strongly into the rubber of the sealing halves 26 and 27.

When the tubular clamping strip according to FIG. 5 is installed, use is made of a springy tubular clamping strip 40 cut lengthwise. The tubular strip is bent open by means of tools in the holes 43 in the strip 43 and is placed over the ends of the abutting sealing halves 26 and 27, after which the tools are removed, It should be noted that a continuous or interrupted strip of the type shown in FIG. 4 can also be fitted in the way described for the strip 40 according to FIG. 5.

The invention finally relates to a method for installing the U-shaped clamping strip according to FIG. 4 and is characterized in that use is made of an approximately U-shape clamping strip whose legs are provided with local bent-in parts and are at an angle of over 90° to the body, the strip is placed over the ends of the abutting sealing halves, the legs are pressed together by means of tools until the yield point is exceeded, so that said angle becomes smaller than 90°, and the tools are removed.

A similar method is applied for the clamping strip according to FIG. 5, when a springy tubular clamping strip that has been cut lengthwise is used, this strip is bent open by means of tools in holes provided in the strip for this purpose, the clamping strip is placed over the ends of the abutting sealing halves, and the tools are removed.

What is claimed is:

1. A reservoir consisting of a plurality of contiguous, prefabricated, plate-shaped concrete sections connected together so as to be movable and water-tight, comprising:

a plurality of vertically extending concrete sections, each having front, back, top, bottom and side wall portions;

a foundation extending around the full length of the reservoir circumference;

upwardly facing groove means provided within said foundation for receiving the bottom portion of said concrete sections together with an amount of mortar for securing the concrete sections therein;

pliable side sealing means for connecting together adjacent side portions of said concrete sections;

each of the side portions of said concrete sections being provided with rabbet means located in the front plain of said concrete sections for receiving said pliable side sealing means;

each of said pliable side sealing means including a deformable spacer extending between the adjacent side wall portions of adjacent concrete sections and from the back to the front thereof, deformable sealing plate means positioned on the front side of said spacer for making the joint between adjacent concrete sections watertight, clamp means for clamping said deformable sealing plate means in a watertight relationship with respect to said concrete sections, said clamping means extending along the length of said deformable sealing plate means.

2. A reservoir according to claim 1, characterized in that, at a height of the assembled concrete sections of at least 2 meters, a reinforced-concrete ring that is not rigidly connected to the sections is mounted around the reservoir.

3. A reservoir according to claim 1, characterized in that said deformable sealing means comprises a one piece rubber plate through which anchoring means pass and the sides of the rubber plate are pressed against said concrete sections by means of continuous strips extending from the top to the bottom thereof, said strips secured by the anchoring means.

4. A reservoir according to claim 1, wherein said deformable sealing means is comprised of a two piece rubber seal, each half consisting of a securing side that can be incorporated in a concrete section and a sealing end that, at least in the assembled position, is bent at right angles and can be provided with means for fastening the sealing end of this half to the corresponding end of the other half, the seal being characterized in that the sealing ends of the rubber seal abut against each other over some length and fastening means for pressing the abutting parts together with some force.

5. A reservoir as in claim 4 wherein the sealing end of each half, at the side away from the other half, changes into a thickened part, a rigid bar being placed near the transition, while a number of approximately U-shaped clasps press the bars towards each other and keep them in place at the transition towards the thickened ends, the legs of the U-shaped clasps being provided for this purpose with local bent-out parts.

6. A reservoir as in claim 4 wherein the sealing ends of each half of the rubber seal, are pressed together, in the assembled condition, by a springy continuous or interrupted, approximately U-shaped clamping strip mounted over the extremities of the sealing ends, the legs of the strip being provided with a local bent-in part that presses into the rubber.

7. A reservoir as in claim 4, wherein the sealing ends of each half of the rubber seal, at the side away from the other half, are pressed together, in the assembled condition, by the edges of a continuous or interrupted, springy, tubular clamping strip that has been cut lengthwise and has been placed over the extremities of the sealing ends, the edges of the cut part pressing into the rubber behind the thickened ends of the rubber seal.

* * * * *